US006023216A

United States Patent [19]

Gress

[11] Patent Number: 6,023,216

[45] Date of Patent: Feb. 8, 2000

[54] TRANSFORMER COIL AND METHOD

[75] Inventor: Matthew L. Gress, Palmetto, Fla.

[73] Assignee: Ohio Transformer, Palmetto, Fla.

[21] Appl. No.: 09/119,199

[22] Filed: Jul. 20, 1998

[51] Int. Cl.[7] ..... H01F 27/30

[52] U.S. Cl. ..... 336/209; 336/185; 336/200; 336/206

[58] Field of Search ..... 336/209, 206, 336/185, 200, 282, 183

[56] References Cited

U.S. PATENT DOCUMENTS

| | | | |
|---|---|---|---|
| 652,027 | 6/1900 | Johannesen | 336/180 |
| 2,817,065 | 12/1957 | Horelick | 336/58 |
| 3,119,085 | 1/1964 | Tiejema | 336/96 |
| 3,170,134 | 2/1965 | Palmer | 336/205 |
| 3,287,681 | 11/1966 | Caldwell | 336/192 |
| 3,292,127 | 12/1966 | Dormaier | 336/84 R |
| 3,297,970 | 1/1967 | Jones | 336/205 |
| 3,386,058 | 5/1968 | Michel | 336/60 |
| 3,483,413 | 12/1969 | Logan | 310/271 |
| 3,531,751 | 9/1970 | Sargent | 336/209 |
| 3,533,037 | 10/1970 | Koch | 336/206 |
| 3,543,206 | 11/1970 | King | 336/192 |
| 3,549,926 | 12/1970 | Pentland | 310/194 |
| 3,555,670 | 1/1971 | Zickar et al. | 29/605 |
| 3,634,164 | 1/1972 | Johannes et al. | 156/169 |
| 3,662,461 | 5/1972 | Lake et al. | 29/605 |
| 3,747,205 | 7/1973 | Moore | 29/605 |
| 3,749,950 | 7/1973 | Lenz | 310/45 |
| 3,934,332 | 1/1976 | Trunzo | 29/605 |
| 4,173,747 | 11/1979 | Grimes et al. | 336/60 |
| 4,239,077 | 12/1980 | Dixon et al. | 156/273.5 |
| 4,460,885 | 7/1984 | Hansen et al. | 336/180 |
| 4,489,298 | 12/1984 | Hall | 336/70 |
| 4,492,944 | 1/1985 | Toba | 336/69 |
| 4,859,978 | 8/1989 | Feather et al. | 336/186 |
| 5,220,304 | 6/1993 | Ho | 336/192 |
| 5,621,372 | 4/1997 | Purohit | 336/60 |

*Primary Examiner*—Michael L. Gellner
*Assistant Examiner*—Tuyen T. Nguyen
*Attorney, Agent, or Firm*—Charles J. Prescott

[57] ABSTRACT

An improved transformer coil of the type characterized as a shell-form or pancake coil used in large scale power transmission transformers. The improvement adds strength to resist lateral edge coil deformation as a result of handling the coil during transformer assembly and as a result of fault current surges. The improvement is directed to tightly spread taping some of the inner and outermost conductor turns together with preferably a heat shrinkable structural tape. This spread taping is periodic or spaced along the outer periphery of the coil for economy and may be staggered in terms of the number of conductor turns wrapped together. Preferably, the innermost conductor turns may also be spread taped in this same manner.

11 Claims, 5 Drawing Sheets

TRANSFORMER COIL AND METHOD

SCOPE OF INVENTION

This invention relates generally to large electrical power transformers, not to smaller distribution transformers, and more particularly to shell-form or pancake conductor coils having improved lateral and longitudinal turn strength.

PRIOR ART

The shell-form style of transformer construction is essential to current modes of electrical power generation and transmission. The inherent mechanical strength of the design to resist forces generated during external short circuits and other electrical surges is excellent. These transformers are called upon to either step up or step down voltage on a highly efficient level.

Such step up or step down transformers incorporate a number of individually wound shell-form or pancake coils which are connected "start-to-start" and "finish-to-finish" to form a "group" of high or low voltages. These groups of coils are placed in certain sequences with appropriate insulation barriers when designed as either single phase or three phase transformers. Because equal electrical current flows through each group of coils in the same direction, magnetic fields which are developed are canceled between each of the coils within the group, thus creating mechanical forces of attraction which drastically increase when large short-circuit current flows during electrical faults occurring external to the transformer.

As a result of these increased attractive forces, some of which are non-axial (radial) because of varying coil inside and outside dimensions to the electrical core steel, the edge margins of the coil can laterally or longitudinally deform, either momentarily or permanently, to the extent that a short may occur between spaced adjacent coils or between turns in the same coil.

Additionally, during coil manufacture, a single length of a conductor groups forming an electrical turn is spiral wound on a horizontal surface around a central mandrel having a shape of a core of the transformer into which the flat coil will be installed as part of a group. Multiple turns of the conductor groups are required in the spiral winding to complete the coil. The conductor groups of each turn are pre-wrapped with an insulating paper material which may include an epoxy thermo set adhesive that, when cured, bonds all conductor groups to add strength to the otherwise somewhat fragile coil as it is lifted and transferred into its assembled position after the coil forming process is complete.

In U.S. Pat. No. 4,489,298, Hall teaches the utilization of a dielectric cover for enclosing the end strands whereby the end strands of adjacent layers are sufficiently insulated to prevent electrical breakdown therebetween. However, this device is not subjected to high mechanical forces, nor does it increase the resistance to deformation during fault current situations.

Trunzo, in U.S. Pat. No. 3,934,332 teaches a method of making electrical coils having improved strength and oil permeability. It is here that an aspect of the teaching of the addition of an adhesive (epoxy) resin to the insulation wrapped around the elongated conductor to be spiral wound into a coil is taught. Another form of heat cureable adhesive addition for strength and insulation is taught by Palmer in U.S. Pat. No. 3,170,134. However, the epoxy resin is used for coil turn stability in these distribution transformers as a manufacturing aid rather than to control mechanical forces.

The following additional U.S. patents are shown to represent the current state of the art in distribution transformer coil construction, method of manufacture and/or utilization:

U.S. Pat. No. 3,662,461 to Lake et al.

U.S. Pat. No. 4,239,077 to Dixon et al.

U.S. Pat. No. 4,492,944 to Toba

U.S. Pat. No. 4,173,747 to Grimes et al.

U.S. Pat. No. 5,621,372 to Purohit

U.S. Pat. No. 2,817,065 to Horelick

U.S. Pat. No. 3,634,164 to Van Hirtum

U.S. Pat. No. 3,555,670 to Zickar et al.

U.S. Pat. No. 4,859,978 to Feather et al.

U.S. Pat. No. 5,220,304 to Ho

U.S. Pat. No. 4,460,885 to Hansen et al.

The present invention provides an improved structure and method of manufacture of shell-form or pancake coils utilized in forming coil groups in large scale power transformers for electrical power transmission. The improved coil adds superior strength to the inner and outermost coil or conductor turns where mechanical forces can be at their maximum by providing spread wrapping of two or more groupings of coil turns. The embodiment of the tape utilized is that of a polyester heat-shrinkable structural tape which, when properly installed and heat shrunk, adds significantly to the resistance of lateral and longitudinal deformation of the inner and outermost coil turns during external transformer faults. Similarly structured coils for other uses are also envisioned to be within the scope of this invention.

BRIEF SUMMARY OF THE INVENTION

This invention is directed to an improved large scale power transformer coil of the type characterized as a shell-form or pancake coil. The improvement adds superior strength to provide coil geometry stability as a result of handling the coil during transformer phase assembly and as a result of fault current surges in operation. The improvement is directed to tightly spread taping the inner and outermost coil turn groups together with a special grade of heat shrinkable structural tape. This spread taping is periodic or spaced along the outer periphery of the coil and may be staggered in terms of the number of coil turn groups wrapped together. The innermost conductor turns are also spread taped in this same manner.

It is therefore an object of this invention to provide a transformer coil of the shell form or pancake type which has inherently greater strength to provide stable coil geometry and resist lateral and longitudinal deformation of the inner and outermost turns of each coil during both transfer at manufacture and during periods of high fault current within the transformer.

It is another object of this invention to provide an improved transformer coil and method of manufacture utilizing spread tape techniques with a high tensile strength heat shrinkable polyester structural tape.

In accordance with these and other objects which will become apparent hereinafter, the instant invention will now be described with reference to the accompanying drawings.

DETAILED DESCRIPTION OF THE INVENTION

Prior Art

In order to fully understand the benefits of the present invention, a discussion of the forces imposed upon the shell-form or pancake coils within an electrical power transformer are first described with respect to FIGS. 1 to 6.

Figure 1:
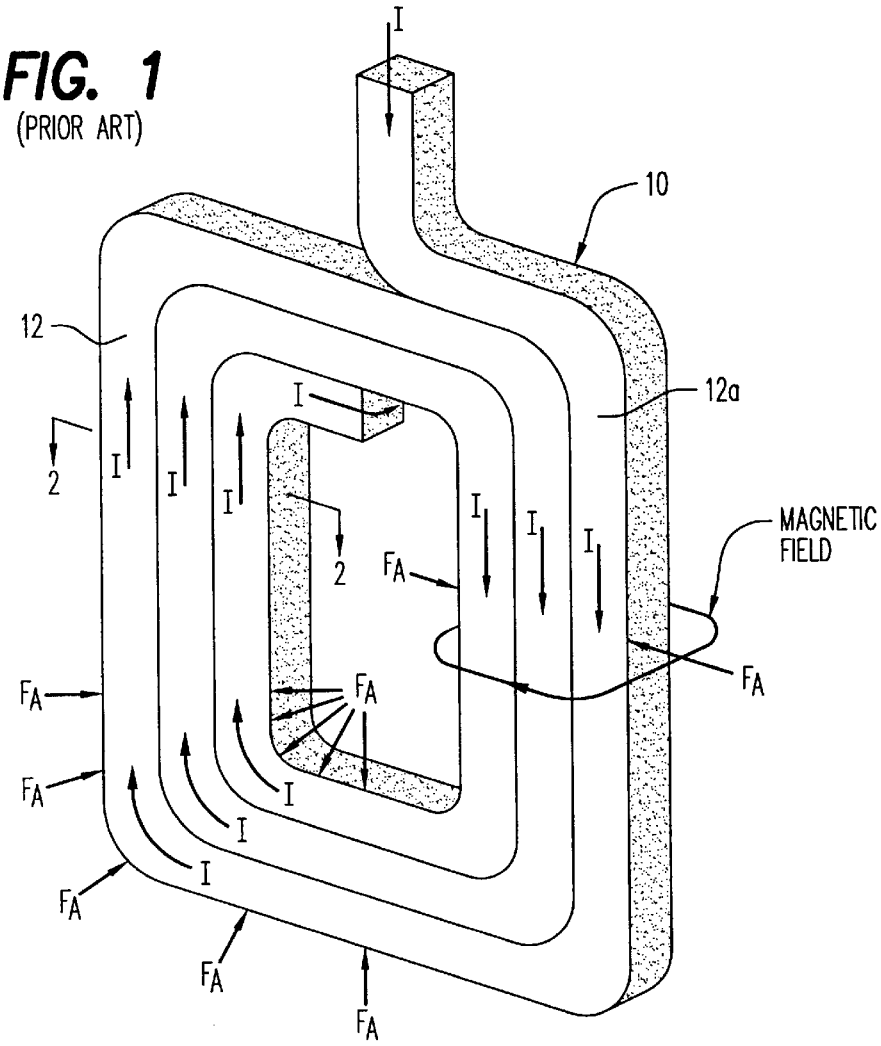
FIG. 1 (PRIOR ART)
FIG. 1 is a simplified perspective view of a typical shell-form or pancake style coil.
Figure 2:
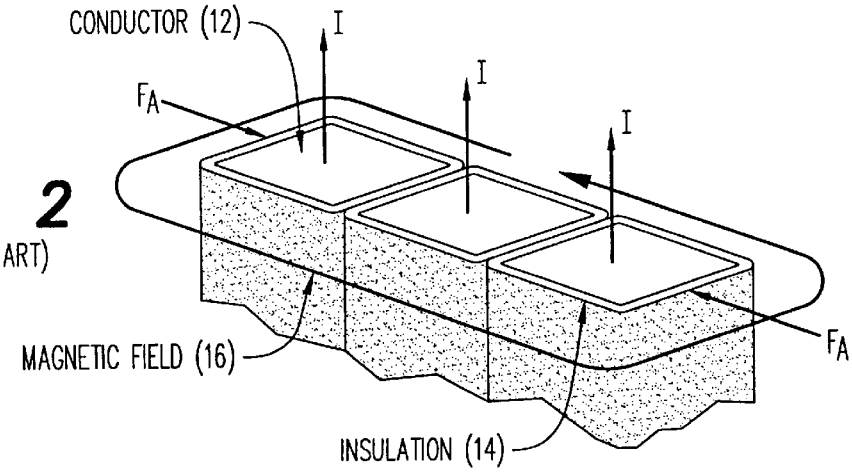
FIG. 2 (PRIOR ART)
FIG. 2 is a section view in the direction of arrows 2—2 in FIG. 1.

Within a typically rectangular pancake coil shown at numeral 10 of FIG. 1, current I flows in the same direction through all adjacent turns 12*a* of this coil 10. As a result, and in accordance with Farraday's Law, the forces $F_A$ acting on each of the turns 12*a* of the elongated conductor(s) 12 are attracted to one another as perhaps better shown in FIG. 2. These conductors 12 are typically formed of strands of copper wire and are highly efficient in current transmission. To prevent current transfer laterally from turn to turn, a layer of insulation (typically paper) 14 is applied around the entire elongated conductor forming each of the coils 10. When the current I flows, a magnetic field 16 is generated resulting in the attractive forces $F_A$ being generated.

Figure 3:
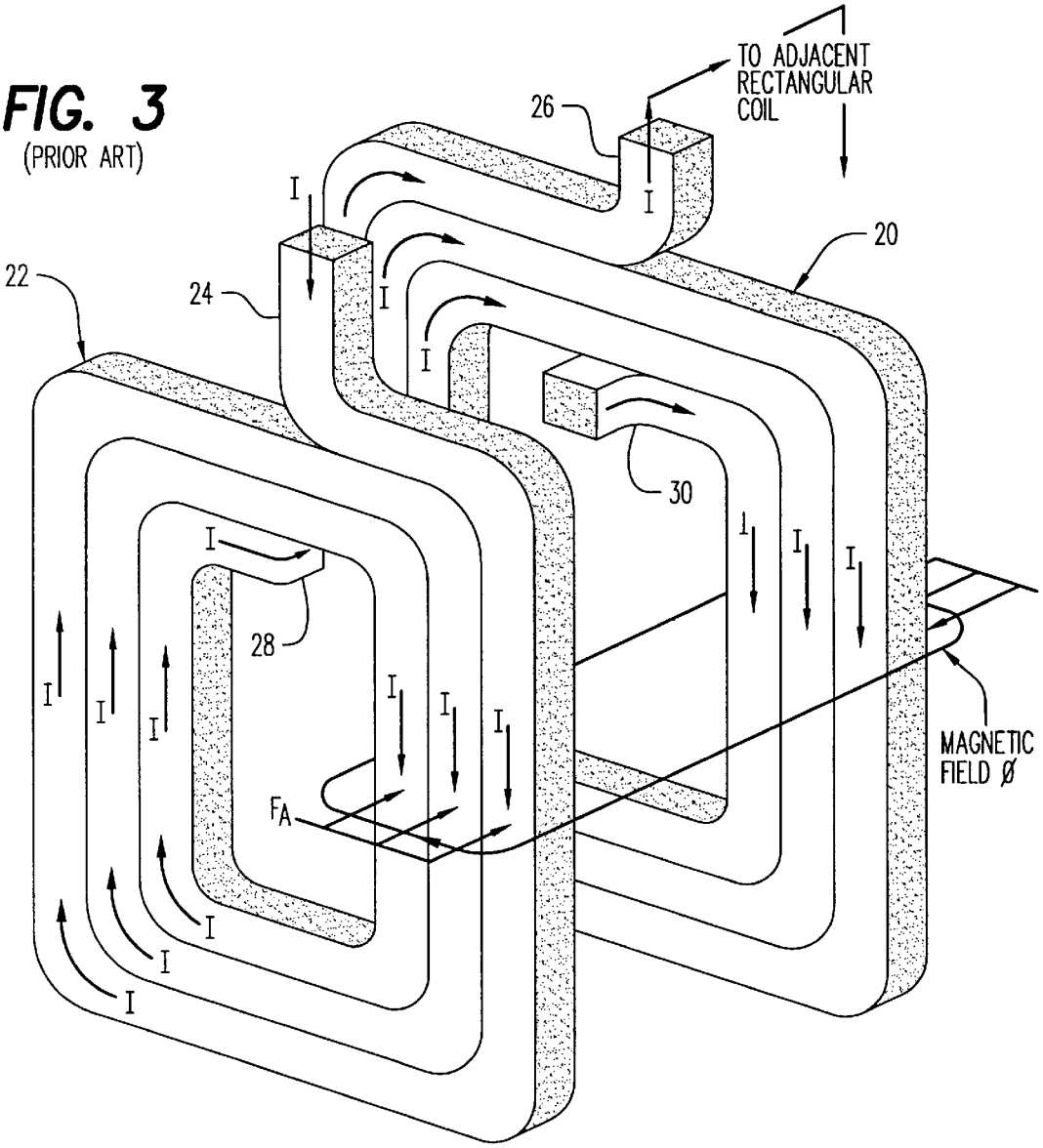
FIG. 3 (PRIOR ART)
FIG. 3 is a simplified perspective view of two adjacent shell-form transformer coils forming a group.

In FIG. 3, two pancake coils 20 and 22 are shown adjacent one another in spaced relationship as may be typically found in a power transformer. These two coils 20 and 22 may be viewed as a "coil group", the direction of current flow I into one coil 22 at 24 and from the adjacent coil 20 at 26. Thus, the coil to coil current flow between points 28 and 30 within each coil group is always in the same direction as shown. As a result, the generated forces $F_A$ are all attractive, tending to force all of the turns and each of the adjacent coils 20 and 22 together. By extending this concept, it becomes apparent that the forces $F_A$ within a coil group are all attractive, serving to bind each coil group together in a tight package as shown generally at 32 in FIG. 4. Insulating spacers between each coil are not shown for clarity. The most common construction of high voltage coil groups uses a graded or tapered insulation where one end is at line potential and the other at ground potential. Each of the coils shown typically at 34, numbered one to twelve, thus increase in physical size with respect to the transformer core 36. Again, the majority of the forces are axial in nature and shown collectively at $F_A$ in response to the current flow I passing through the adjacent electrically isolated coils 34 of the coil group 32.

Figure 4:
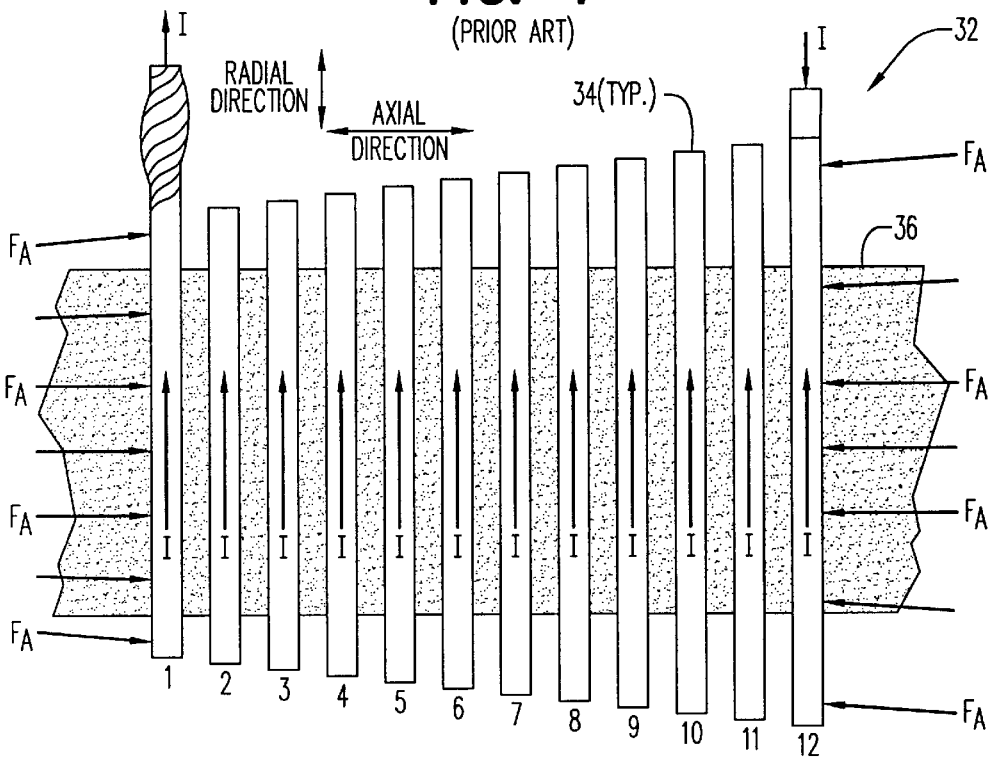
FIG. 4 (PRIOR ART)
FIG. 4 is a simplified side elevation view of one stage of a typical electrical power transformer.
Figure 5:
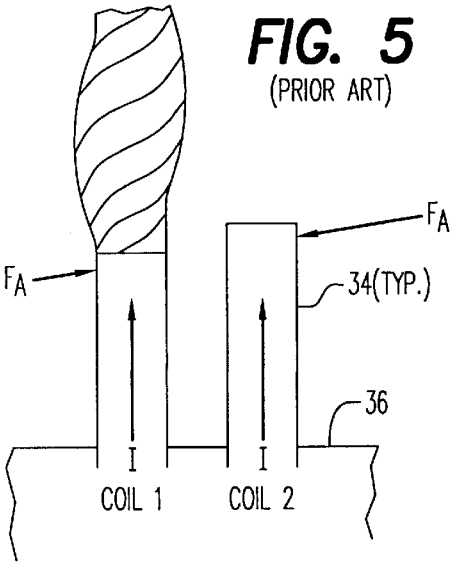
FIG. 5 (PRIOR ART)
FIG. 5 is an enlarged view of a portion of FIG. 4.
Figure 6:
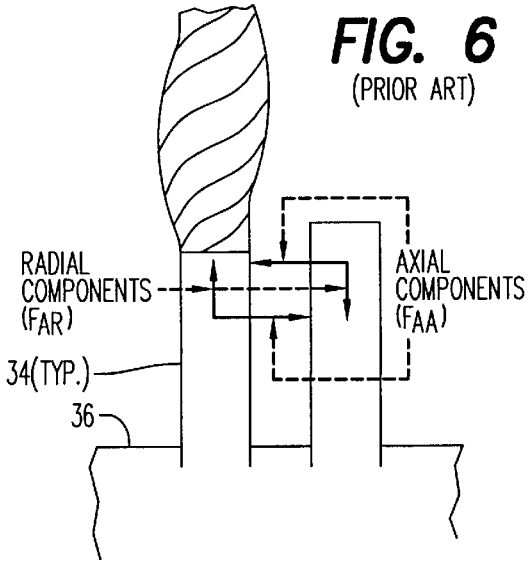
FIG. 6 (PRIOR ART)
FIG. 6 is the same view as in FIG. 5 showing the forces acting on the inner and outermost portions of and between each coil of FIG. 4.

Referring now to FIGS. 5 and 6, although the vast majority of the inductive forces $F_A$ are axial as above described, because of the incrementally increase in radial size of each adjacent coil as shown in FIG. 4, a smaller radial component shown at $F_{AR}$ accompanies the purely axial force component $F_{AA}$ which is resolved into vectors from the slightly non-axial total force $F_A$ shown in FIG. 5. This radial force component $F_{AR}$ is created because of the overhanging of one coil 34 to the next. If the outer margins or outermost turns of each coil 34 are not adequately supported, the conductor wire forming each of the outermost electrical turns will move toward the corresponding portions of the adjacent coil or one turn of a coil will attempt to bridge another longitudinal turn. This may violate the electrical clearance requirements between coils and may even result in physical contact which will create an electrically unstable condition which may ultimately lead to the electrical failure of the transformer within which the coil group 32 is housed.

As previously described, even the use of an epoxy adhesive applied around the conductor groups, along with low density electrical pressboard insulation enclosures typically used around each of the inner and outer coil turns to control these mechanical forces, are in many instances inadequate to prevent this transformer failure mode.

The Invention

Figure 7:
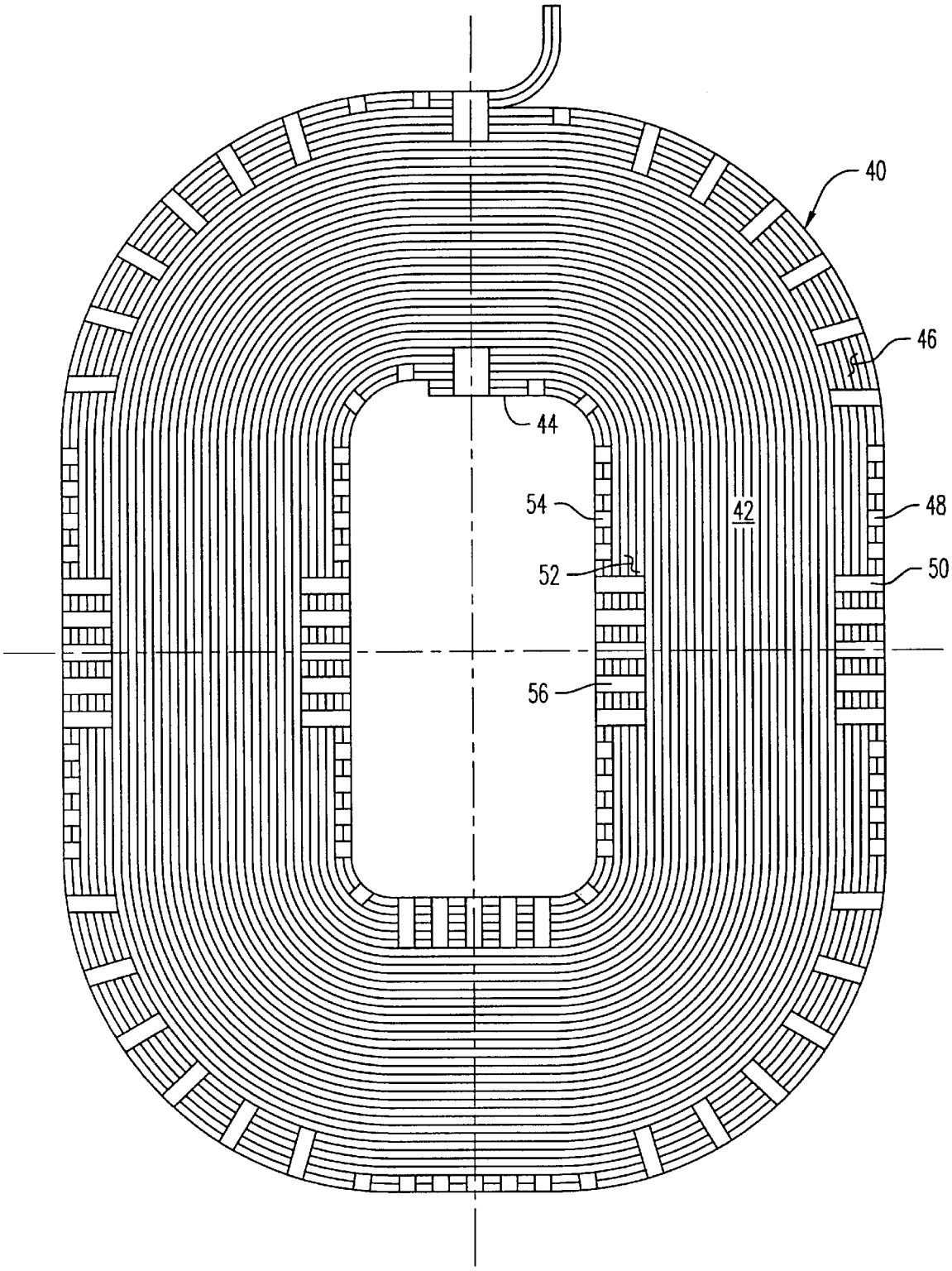
FIG. 7 is a top plan view of the invention.
Figure 8:
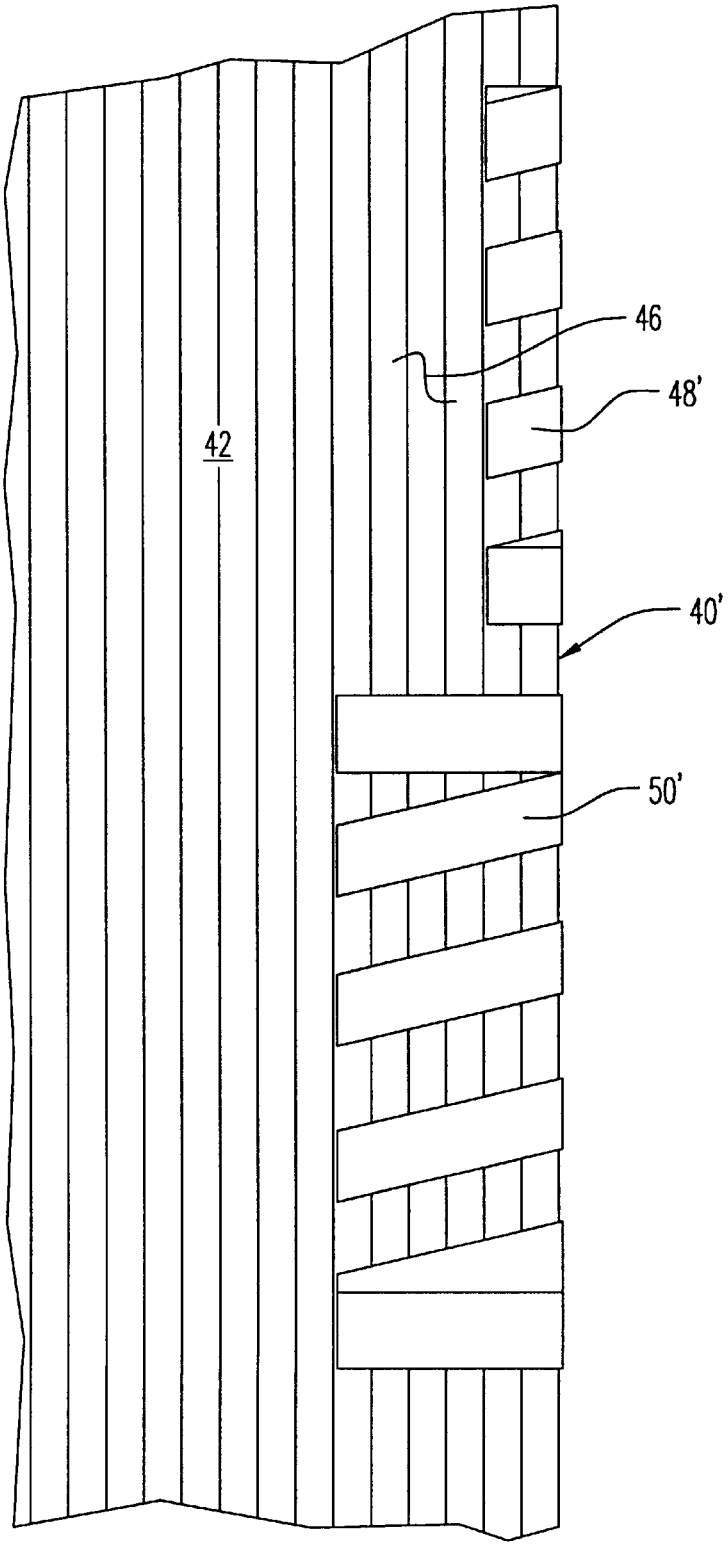
FIG. 8 is an enlarged view of the inner and outermost turns of the improved coil of FIG. 7 showing the preferred embodiment of spread taping.

Referring now to FIGS. 7 and 8, the invention is shown generally at numeral 40 in FIG. 7 embodied in a large shell-form or pancake coil produced and structured as previously described. The coil 40 is formed around a rectangular mandrel (not shown) atop a flat, horizontal surface by spiral winding an elongated electrical conductor or turn around the mandrel, the conductor being formed of multiple groups of copper strands and wrapped with insulating paper. By repeated spiral winding, a central rectangular open portion 44 is formed which is sized to receive the core of the transformer coil positioned therethrough. The spiral winding continues for the appropriate number of turns to achieve the desired electrical and/or physical features of each coil 40.

During coil manufacture, at least two of the outermost groups of turns 46 are spread wrapped together with tape 48 and 50. Groups of tape 48 are each individually tightly wrapped around the two outermost conductor turns 46 in spaced apart or spread-wrapped fashion, while groups of tape 50 are each individually tightly wrapped around six of the outermost conductor turns 46 in spaced apart or spread-wrapped fashion as shown. The preferred embodiment of the tape utilized is a polyester prestretched tape which will heat shrink approximately 20% to 25% from its original length when heated to an appropriate temperature and for a specific time period. Such high strength heat shrinkable tape is available from The Dupont Corporation, called their MYLAR polyester film, from Allis-Chalmers under product ACM 6198 polyester film prestretched shrinkable tape, and from the Dunstone Company in Charlotte, N.C. called simply HI-SHRINK tape. This 0.75" wide structural tape typically has a minimum tensile strength of 20,000 p.s.i. to accomplish the mechanical enhancement provided by the present invention.

As seen in FIG. 7, each of these groups of tape 48 and 50 are done by individual spaced wraps of the tape around the desired number of turn groups 46. Likewise, the number of conductor turns included within each tape 48 and 50 may vary from at least two and up to preferably about six turns and be staggered or alternated in that aspect along the periphery of the coil 40 as shown and otherwise as desired.

As seen in FIG. 8, an alternate form of taping the spread may be done with one continuous length of tape at 48' and 50'. The beneficial strengthening of this embodiment 40' is similar to that of FIG. 7 and thus the selection of the form of wrapping the tape 48/50 or 48'/50' is a matter of design choice.

In FIG. 7, the innermost turn groups 52 are also strengthened by wrapped tape 54 and 56 as previously described. Preferably both the outer and the inner turns groups 46 and 52, respectively are strengthened by spread taping preferably utilizing the heat shrinkable structural tape which is then further tightened by heating the entire coil 40 or 40' to a temperature and time period sufficient to properly shrink the tape 48, 50, 54 and 56 or 48' and 50'. Other forms of high tensile strength without a heat shrink feature may also be used if wrapped very tightly when installed.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

What is claimed is:

1. A shell form or pancake transformer coil comprising:

a plurality of layers formed by spirally winding an elongated conductor to define a hollow central portion sized to receive a transformer core;

said conductor having an insulating layer wrapped therearound which bonds and electrically isolates adjacent wound conductor turns of said conductor;

tape tightly spread wrapped around plural spaced outer segments of at least two adjacent outermost said conductor turns, said tape of sufficient strength and tightness whereby lateral mechanical strength of said coil to resist lateral deformation of said outermost conductor turns during transfer and high current loading of said coil is increased;

said outer segments include staggered varying numbers of said outermost conductor turns.

2. A transformer coil as set forth in claim 1, wherein:

said tape is characterized as having high tensile strength and is heat shrinkable whereby tape tightness and mechanical strength of said outermost conductor turns is further increased.

3. A transformer coil as set forth in claim 1, further comprising:

additional said tape tightly spread wrapped around plural spaced inner segments of at least two adjacent innermost said conductor turns of a portion of an inner periphery of said hollow central portion whereby lateral mechanical strength of said coil at said innermost conductor turns is increased.

4. A transformer coil as set forth in claim 3, wherein:

said inner and outer segments include staggered varying numbers of said innermost and said outermost conductor turns, respectively;

said tape is characterized as having high tensile strength and is heat shrinkable whereby tape tightness and mechanical strength of said outermost conductor turns is further increased.

5. A transformer coil as set forth in claim 1, wherein:

said outer segments extend along an entire length of said outer periphery.

6. A transformer coil as set forth in claim 1, wherein:

said outer segments extend along arcuate portions of said outer periphery.

7. A transformer coil as set forth in claim 1, wherein:

said outer segments are substantially evenly spaced apart and extend along an entire length of said outer periphery.

8. In a shell-form or pancake transformer coil comprising a plurality of layers formed by spirally winding an elongated conductor to define a hollow central portion sized to receive a transformer core, said conductor having an insulating layer wrapped therearound which bonds and electrically isolates adjacent wound conductor turns of said conductor, the improvement comprising:

tape tightly spread wrapped around plural spaced outer segments of at least two adjacent outermost said conductor turns of a portion of an outer periphery of said coil whereby lateral mechanical strength of said coil to resist lateral deformation of said outermost conductor turns during transfer and high current loading of said coil is increased;

said outer segments include staggered varying numbers of said outermost conductor turns.

9. In a transformer coil as set forth in claim 8, wherein:

said tape is characterized as having high tensile strength and is heat shrinkable whereby tape tightness and mechanical strength of said outermost conductor turns is further increased.

10. In a transformer coil as set forth in claim 8, wherein:

additional said tape tightly spread wrapped around plural spaced inner segments of at least two adjacent innermost said conductor turns, said inner segments extending along a portion of an inner periphery of said hollow central portion whereby lateral mechanical strength of said coil at said innermost conductor turns is increased.

11. In a transformer coil as set forth in claim 10, wherein:

said inner and outer segments include staggered varying numbers of said innermost and said outermost conductor turns, respectively;

said tape is characterized as having high tensile strength and is heat shrinkable whereby tape tightness and mechanical strength of said outermost conductor turns is further increased.

* * * * *